US007013014B2

(12) United States Patent
Ach-Kowalewski et al.

(10) Patent No.: US 7,013,014 B2
(45) Date of Patent: Mar. 14, 2006

(54) HEARING DEVICE SYSTEM WITH BEHIND-THE-EAR HEARING AID DEVICES FASHIONED SIDE-SPECIFIC

(75) Inventors: Gerhard Ach-Kowalewski, Effeltrich (DE); Hartmut Ritter, Neunkirchen am Brand (DE)

(73) Assignee: Siemens Audiologische Technik GmbH, (DE)

( * ) Notice: Subject to any disclaimer, the term of this patent is extended or adjusted under 35 U.S.C. 154(b) by 0 days.

(21) Appl. No.: 10/741,471

(22) Filed: Dec. 19, 2003

(65) Prior Publication Data

US 2004/0184630 A1 Sep. 23, 2004

(30) Foreign Application Priority Data

Dec. 20, 2002 (DE) ..... 102 60 304

(51) Int. Cl.
*H04R 25/00* (2006.01)

(52) U.S. Cl. ..... 381/313; 381/330; 381/356; 381/357

(58) Field of Classification Search ..... 381/312, 381/313, 322, 324, 328, 330, 23.1, 355–358, 381/380, 381, 91, 92, 122, 361; 181/128, 181/129

See application file for complete search history.

(56) References Cited

U.S. PATENT DOCUMENTS

| | | | | |
|---|---|---|---|---|
| 6,327,370 | B1 | 12/2001 | Killion et al. | |
| 6,424,721 | B1 * | 7/2002 | Hohn | 381/313 |
| 2002/0181725 | A1 | 12/2002 | Johannsen et al. | |
| 2003/0156725 | A1 * | 8/2003 | Boone et al. | 381/312 |

FOREIGN PATENT DOCUMENTS

| | | |
|---|---|---|
| DE | 199 08 194 | 7/2000 |
| DE | 199 25 907 | 10/2000 |
| EP | 0 499 699 | 11/1991 |
| EP | 1 025 744 | 6/2002 |

* cited by examiner

*Primary Examiner*—Huyen Le
(74) *Attorney, Agent, or Firm*—Schiff Hardin LLP

(57) ABSTRACT

In order to improve the directional effect in a hearing device system with a hearing aid device worn behind the left ear and a hearing aid device worn behind the right ear, the hearing aid devices are to be fashioned side-specific. Furthermore, each hearing aid device has at least three sound entrance ports that are arranged substantially along a straight line. When the hearing aid devices are worn, these straight lines are turned toward the straight-ahead viewing direction of a hearing device user (in contrast to symmetrically-fashioned hearing aid devices) due to the particular fashioning of the hearing aid devices. A directional effect thus is achieved by the natural formation of the pinna.

10 Claims, 3 Drawing Sheets

HEARING DEVICE SYSTEM WITH BEHIND-THE-EAR HEARING AID DEVICES FASHIONED SIDE-SPECIFIC

BACKGROUND OF THE INVENTION

1. Field of the Invention

The present invention concerns a hearing device system of the type having a left hearing aid device, fashioned side-specific, to be worn behind the left ear, and a right hearing aid device, fashioned side-specific, to be worn behind the right ear.

2. Description of the Prior Art

European Application 0 499 699 discloses a behind-the-ear hearing aid device with a number of sound entrance ports and at least two microphones that can alternatively be attached to an amplifier, connected either individually or in parallel, by means of an electronic circuit. The directional characteristic can hereby be changed by the a electronic circuit.

To improve the directional hearing, a behind-the-ear hearing aid device is known from German PS 199 08 194 that has at least one microphone system with at least two microphones and the sound entrance port of at least one microphone is laterally aligned from the head. To improve the alignment as well as the seating of the behind-the-ear hearing aid device, a molding is provided on the housing wall (housing shell) facing the head, via which the entire hearing device housing is turned in the viewing direction of the hearing device user.

A behind-the-ear hearing aid device is known from German OS 199 25 907 that has a microphone system attached to the hearing device housing and connected with the housing via a ball joint. The microphone system can be turned in the horizontal and the vertical direction via the ball joint. A disadvantage of this known hearing aid device is the elaborate and accident-sensitive microphone system.

A hearing device with a microphone arrangement is known from German Translation 698 06 040 in which four microphones are arranged on a left ear support piece of eyeglasses and four microphones are arranged on a right ear support piece of the eyeglasses, thus in two approximately parallel straight lines.

An in-the-ear hearing aid with a microphone arrangement is known from U.S. Pat. No. 6,327,370 in which four sound entrance ports are arranged in a straight row.

SUMMARY OF THE INVENTION

An object of the present invention is to improve the directional effect in a behind-the-ear hearing aid device.

This object is achieved in accordance with the invention by a hearing device system with a left hearing aid device, fashioned side-specific, to be worn behind the left ear, and a right hearing aid device, fashioned side-specific, to be worn behind the right ear; wherein each hearing aid device has a housing and a microphone system arranged in the housing; with at least three sound entrance ports in the housing being associated with the microphone system. The sound entrance ports are arranged substantially along a straight line; and the respective straight lines of the hearing aid devices worn behind the left ear and behind the right ear are directed (in contrast to a symmetrically fashioned hearing aid device) toward the straight-ahead viewing direction of a hearing device user.

Behind-the-ear hearing aid devices typically exhibit a symmetrical housing shape. They can thereby alternatively be worn both on either the left ear or the right ear. Furthermore, modern behind-the-ear hearing aid devices possess twin- or multi-microphone systems (microphone systems with two or more microphones), with which directional microphones with (dependent on the hearing device housing) forward-directed dipoles (sensibility lobes) are formed. Given a symmetric housing shape, the forward-directed dipoles, when the hearing aid device is worn, diverge from the head in a natural manner (due to the anatomy of the head), such that the sensitive points of these dipoles are at an angle of approximately 25° to 45° with regard to the straight-ahead viewing direction of the hearing device user.

Due to the side-specific design of the inventive hearing aid device housing, with "left" and "right" hearing aid devices worn as intended, the dipoles are turned back toward the direction of the straight-ahead viewing direction of the hearing device user. The turning of the dipoles caused by being worn on the head can be partially or completely compensated by the asymmetric assembly (adapted to the exterior anatomy of the head and the ears) of the hearing aid device with regard to the arrangement of the sound entrance ports of the microphones. The sound acceptance from the front is thereby non-electronically improved in a simple manner, as this is also achieved by the external ear (pinna).

In a worn hearing aid device, the directional lobe resulting from the invention is more closely aligned in the viewing direction of the hearing device compared to a symmetrical hearing aid device, and thus enables an improved understanding of speech, or the desired sound. For example, by the special arrangement of the sound entrance ports, and depending on the underlying shape of the directional dipole, between 0.5 dB and 1 dB of directional effect (directionality measurement) can be obtained in a twin (second order) microphone system, in contrast to a symmetric hearing aid device. In microphone systems of higher order, an even greater improvement is possible.

The sound entrance ports of the microphones of a behind-the-ear hearing aid device according to the invention are—at least approximately—arranged along a straight line. In a worn hearing aid device, this straight line is aligned in the straight-ahead viewing direction of the hearing device user. The microphone system thus detects best the sound portion that is incident at the microphone system from the viewing direction of the hearing device user. The turning of the straight lines by a few degrees toward the viewing direction, however, also effects a clear improvement of the directional effect in the hearing aid device according to the invention, in contrast to a conventional symmetrically-fashioned hearing aid devices, even if the alignment of the straight lines still does not coincide with the viewing direction.

Furthermore, in a hearing aid device according to the invention, given a worn hearing aid device and a straight-ahead viewing direction, the sound entrance ports are, or a straight line running through the sound entrance ports is, in a horizontal plane. The sensitivity lobe in a worn hearing aid device thereby also better coincides in a horizontal direction with the straight-ahead viewing direction of the hearing device user.

The invention offers a number of possibilities to align the sound entrance ports of the microphones in a behind-the-ear hearing aid device. In an embodiment of the invention, the housing of the left hearing aid device as well as the housing of the right hearing aid device are fashioned side-specific, at least in the region of the sound entrance ports. The arrangement of the sound entrance ports thus already are determined by the housing shape. A disadvantage, however, is the requirement to have to produce two different housings for the left and right hearing aid devices.

In another embodiment of the invention, the housing of a behind-the-ear hearing aid device according to the invention is assembled in a modular manner. The housing is thereby formed of a base module and a microphone module. The base module is symmetric and the microphone module is fashioned side-specific. This has the advantage that the left hearing aid device and the right hearing aid device substantially coincide, since for these the same base modules can be used. Only in the region of the microphones is there a difference between the left hearing aid device and the right hearing aid device. In addition to this difference, an adaptation to different anatomical conditions can ensue by means of differently fashioned microphone modules for the same side of the head. Furthermore, hearing aid devices with different functional performance characteristics can be produced in a simple manner with different microphone modules. For example, hearing aid device with three or four microphones can be offered that differ only in the microphone modules.

In a further embodiment of the invention, in a hearing device system with a left hearing aid device and a right hearing aid device according to the invention, only the sound entrance ports are arranged side-specific in the respective housing in symmetric hearing device housings. This can be achieved, for example, with housings having a cross section that is substantially wedge-shaped in the region of the sound entrance ports of the microphones. Such a hearing aid device is thus substantially narrower on the housing side at the front of the worn hearing aid device, in the viewing direction, than at the rear housing side. A side-specific fashioning of the hearing aid device then already exists by the arrangement of the sound entrance ports on the left or on the right side of a housing. This has the advantage that substantially identical housings can be produced that differ only in the arrangement of their sound entrance ports for the microphones. This can be subsequently introduced (for example, by bores) in the prefabricated housings.

In a further embodiment of the invention the microphones of a hearing aid device according to the invention are arranged on a microphone carrier. This is advantageous in connection with a hearing aid system with symmetrical housings for the left hearing aid device and the right hearing aid device and only side-specific arrangement of the sound entrance ports, since the side-specific fashioning of the hearing aid devices can be affected by a side-specific arrangement of the microphones on the respective microphone carrier alone. To produce different left and right hearing aid devices, thus only the production of different microphone units, each with one microphone carrier and a number of microphones, is necessary. In aversion of this embodiment, the microphone carrier is fashioned side-specific. Different microphone units with a number of microphones and a microphone carrier thus can be produced in a simple manner for left or right hearing aid devices.

To treat a hearing device user with a hearing device system according to the invention, an acoustician can maintain a number of different embodiments of hearing device systems according to the invention in inventory. Thus, for example, hearing aid devices that effect a turning of the dipole by 15°, 20° or 25° (in comparison to symmetrically-fashioned hearing aid devices) can be kept on hand. Depending on the individual anatomical conditions of the hearing device user, the optimal hearing device system for the hearing device user then can be selected.

DESCRIPTION OF THE PREFERRED EMBODIMENTS

Figure 1:
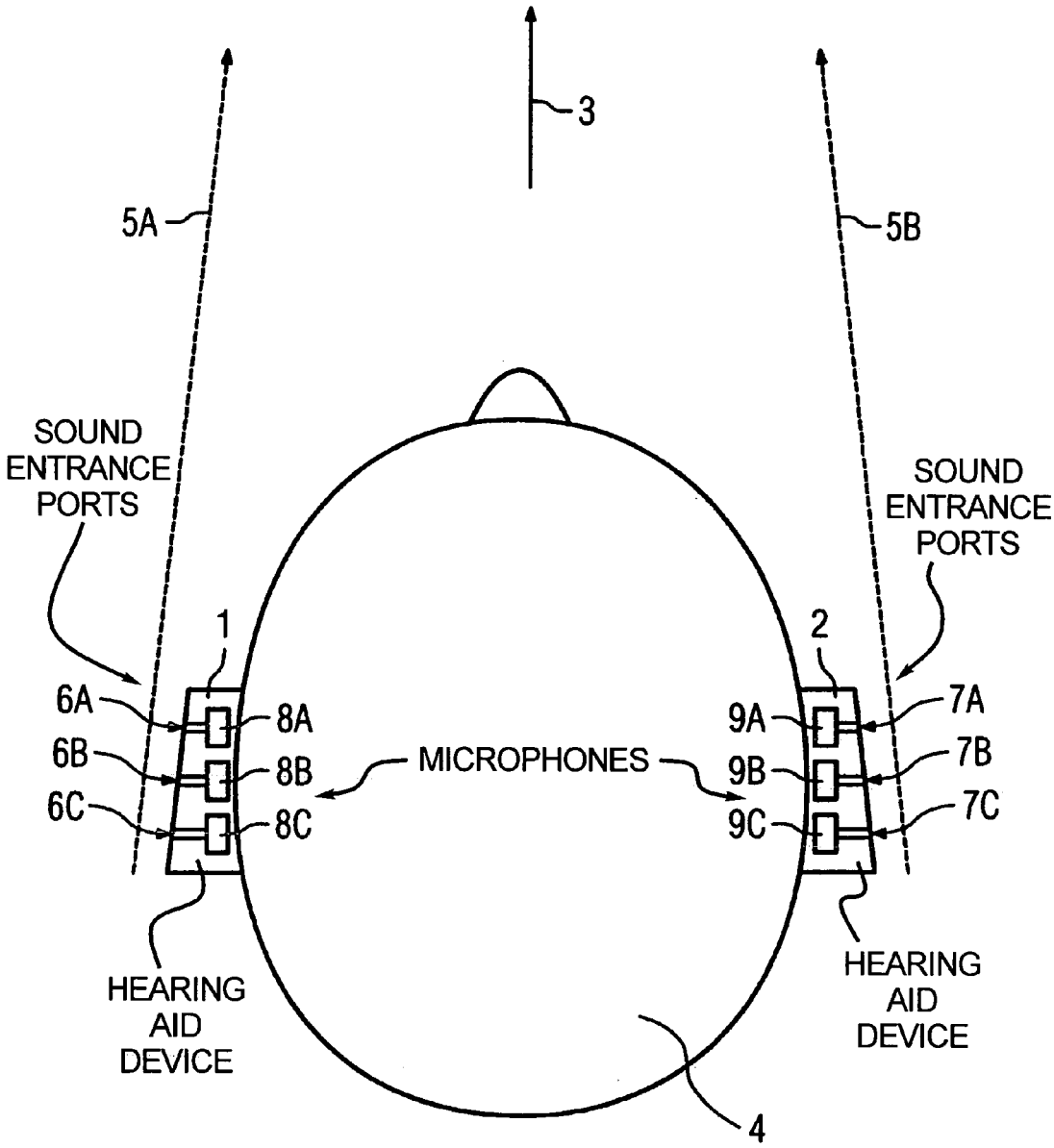
FIG. 1 shows a hearing device system with side-specific hearing aid devices worn behind the left ear or behind the right ear in accordance with the invention.

FIG. 1 is a schematic, greatly simplified illustration of a hearing device system 1, 2, with, according to the invention, a hearing aid device 1 worn behind the left ear and a hearing aid device 2 worn behind the right ear. In a conventional behind-the-ear hearing aid device with a directional microphone system, the dipole of the directional microphone system is directed forwardly with regard to the hearing device housing, and the dipole alignment in particular is determined by the sound entrance ports of the microphones proceeding in a straight line. Thus, the alignment is typically turned laterally outwardly at an angle between 25° and 45° with regard to the straight-ahead viewing direction 3 of a hearing device user 4. The alignment it is different in the hearing device system 1, 2 according to the invention. In this, the dipoles 5A, 5B, starting from therein a position in conventional hearing device system, are turned toward the straight-ahead viewing direction 3 of the hearing device user 4. A shifting of the dipoles by a few degrees toward the viewing direction effects a clear improvement of the directional effect. The side-specific fashioning of the hearing aid devices 1 and 2 of the hearing device system 1, 2 according to FIG. 1 ensues in the exemplary embodiment by a housing cross-section that is fashioned substantially wedge-shaped of the hearing aid devices 1 and 2, as well as the lateral alignment (pointing away from the head) of the sound entrance ports 6A, 6B, 6C, or 7A, 7B, 7C, of the respective microphones 8A, 8B, 8C, or 9A, 9B, 9C.

By a special side-specific fashioning of the hearing aid devices 1, 2, the alignment of the dipoles 5A, 5B can advantageously—at least approximately—also be brought into congruence with the straight-ahead viewing direction 3. It is even possible to align the straight lines running through the sound entrance ports 6A, 6B, 6C or 7A, 7B, 7C of the microphones 8A, 8B, 8C or 9A, 9B, 9C (as shown in FIG. 1) such that these intersect in front of the hearing device user 4. Overall, the invention thus enables the turning of the dipoles of the directional microphone system, caused by being worn behind the left or right ear, to be partially or completely compensated.

Figure 2:
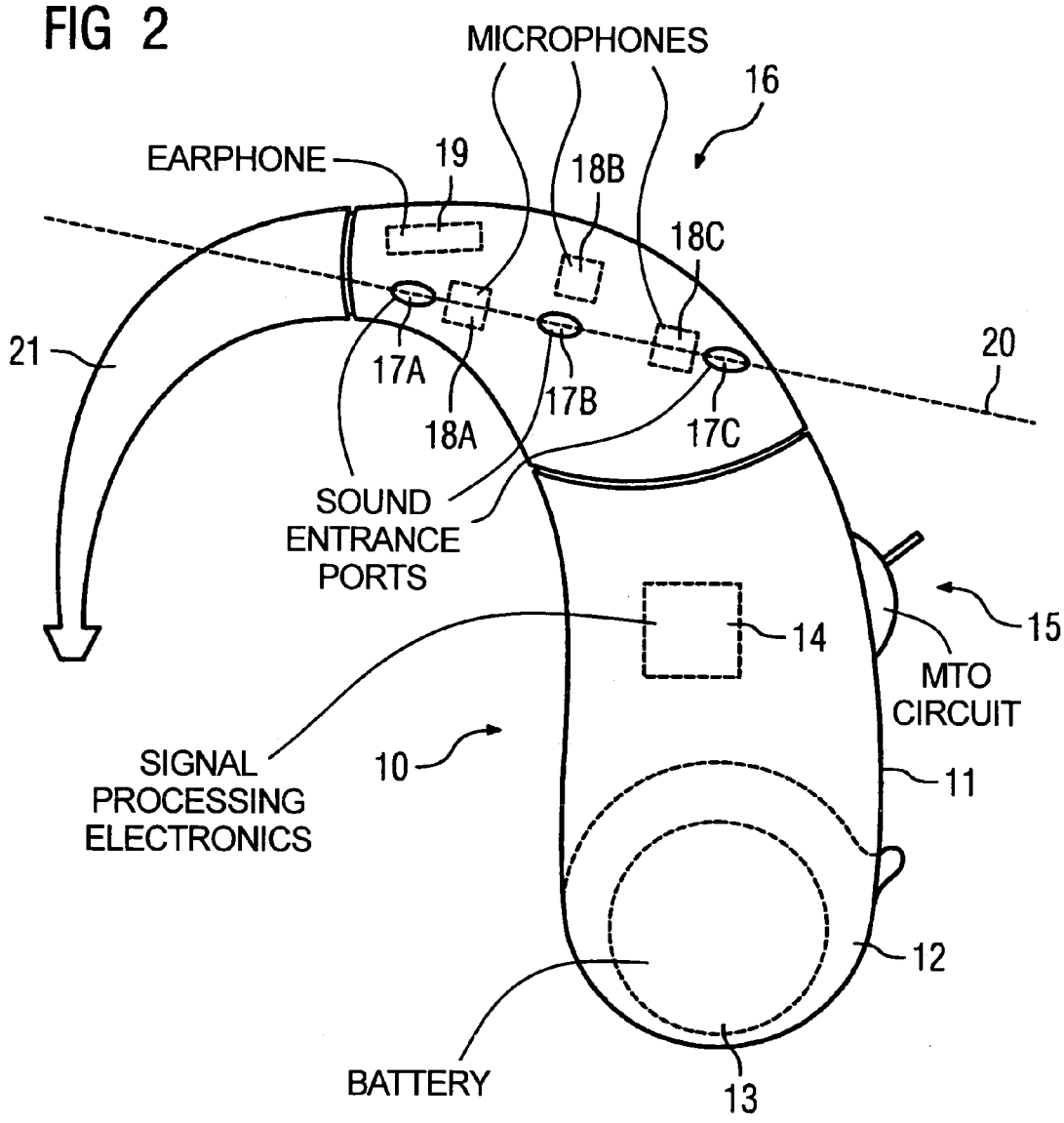
FIG. 2 shows a hearing aid device worn behind the left ear with a microphone module in accordance with the invention.

FIG. 2 shows a behind-the-ear hearing aid device 10 in modular form. The hearing aid device 10 has a base module 11, with a battery chamber. 12 for accepting a battery 13 for voltage supply of the hearing aid device 10, signal processing electronics 14, and an MTO circuit 15 to turn off the hearing aid device (switch position O), as well as to turn on and toggle the reception between microphone (switch position M) and telephone coil (switch position T). Furthermore, the hearing aid device 10 has a microphone module 16 with three sound entrance ports 17A, 17B, 17C. The microphone module 16 is fashioned side-specific via the sound entrance ports 17A, 17B, 17C. FIG. 2 thus shows a microphone module 16 for a hearing aid device according to the invention worn behind the left ear, since in the shown microphone module sound entrance ports of the microphone are located only on the left side of the housing (visible from the drawing). A microphone 18A, 18B or 18C in which an acoustic input signal is converted into electrical input signals is respectively associated with each sound entrance port. The microphone module 16 also has an earphone 19 for converting an electrical output signal back into an acoustic output signal.

According to the invention, the sound entrance ports 17A, 17B and 17C are arranged along a straight line 20. Furthermore, the housing of the microphone module 16 is fashioned such that it is relatively wide in the region of the rear sound entrance port 17C and relatively narrow in the region of the front sound entrance port 17A. In a worn hearing aid device 10, the straight line 20 running through the three sound entrance ports 17A, 17B and 17C is thereby turned toward the viewing direction of the hearing device user.

A microphone module for a behind-the-ear hearing aid device according to the specification is fashioned laterally reversed corresponding to the microphone module 16, and likewise, in a conventional hearing aid device, effects a turning toward the viewing direction of the straight line (pointing laterally away from the head) through the sound entrance ports of the microphone.

Differing from the shown exemplary embodiment according to FIG. 2, in which each sound entrance port 17A, 17B, 17C is associated with an omnidirectional microphone 18A, 18B, 18C, a hearing aid device according to the invention can have one or more gradient microphones that inherently (thus without the circuiting of a number of microphones) effect a directional effect, and in which at least two sound entrance ports are associated with the microphone.

To wear the hearing aid device 10 behind the ear, the hearing aid device is provided in a known manner with a hook 21. The modular assembly of the hearing aid device 10, with a base module 11 that can be used in a left and a right hearing aid device, as well as a microphone module 16 that effects the side-specific fashioning of the hearing aid device 10, can minimize the production costs of the hearing device system. It is also possible to produce different microphone modules that allow for different anatomical conditions for the same side of the head. Thus, for example, microphone modules can be maintained in inventory that effect a turning of the dipole of the microphone system by 15, 20, or 25°. Furthermore, hearing aid devices with three, four or more microphones can be offered. Thus a number of different hearing aid devices can be offered merely by the selection of different microphone modules.

Figure 3:
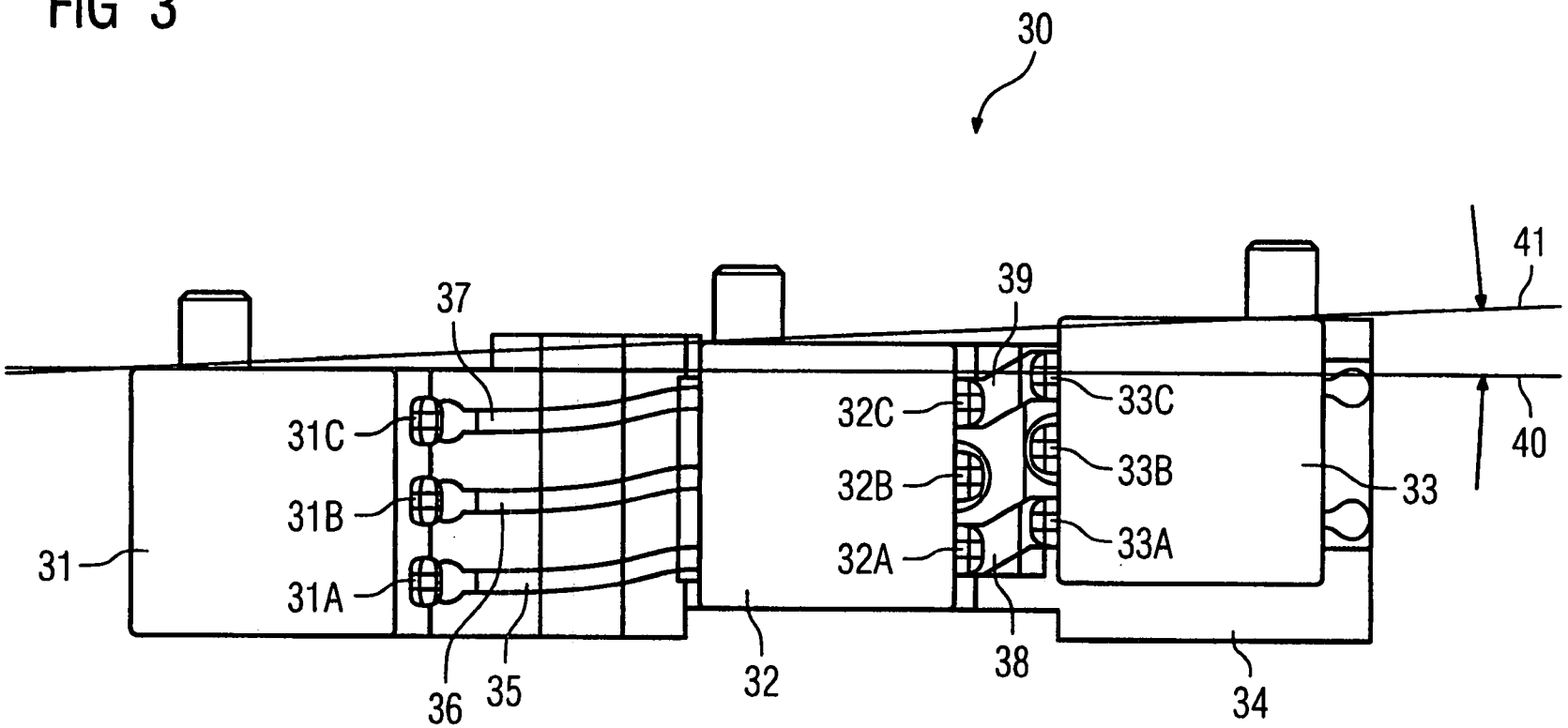
FIG. 3 shows a microphone unit with three microphones and a microphone carrier fashioned side-specific in accordance with the invention.

FIG. 3 shows an exemplary embodiment of a microphone unit 30 that can be used in a behind-the-ear hearing aid device according to the invention. The microphone unit 30 has three omnidirectional microphones 31, 32, and 33 that are arranged on a microphone carrier 34. The microphones 31–33 are omnidirectional microphones that can be connected to form a microphone system of at most the second order via a suitable electrical circuit (not shown). The microphone carrier 34 also is provided with contacts 31A, 31B, 31C; 32A, 32B, 32C as well as 33A, 33B, 33C, by means of which a contacting of the microphones 31–33 ensues. Furthermore, the microphone carrier 34 is provided with conductor traces 35–39 to conduct signals. To simplify the assembly, the microphone unit 30 can be prefabricated as a self-contained unit. It is also possible for the electronic circuit to form a directional microphone system from the three omnidirectional microphones 31, 32 and 33, likewise arranged directly on the microphone carrier 34 (not shown).

In the microphone unit 30 in the exemplary embodiment according to FIG. 3, it can be seen that the microphones 31–33 are not arranged along a straight line 40. Rather, the microphones 31–33 are arranged at an angle a displaced along a straight line 41. The microphone unit 30 is thereby particularly suited for assembly in a hearing aid device with a wedge-shaped cross-section according to the invention. The housing of the hearing aid device can be fashioned quite symmetrically. A side-specific hearing aid device is made from a hearing aid device with symmetric housing by the connection with the microphone system 30. In order to create a hearing device system with a hearing aid device according to the invention worn behind the left ear and with a hearing aid device according to the invention worn behind the right ear, only respectively different microphone units 20 must then be used in the corresponding hearing device housings, and if necessary the sound entrance ports of the housing side respectively proximal thereto are sealed in the worn hearing aid devices.

In addition to the shown exemplary embodiment with different microphone units to produce a left as well as a right hearing aid device, identical microphone units for a left hearing device housing and a right hearing aid device naturally also can be provided in a hearing aid device according to the invention. Moreover, the microphones do not necessarily have to be arranged displaced on a microphone carrier. For this, the assembly in the different hearing aid devices only needs to ensue laterally reversed. Nevertheless, side-specific hearing aid devices are thereby obtained according to the invention, since then in one hearing aid device the sound entrance ports are on the left housing side, and in the other hearing aid device the sound entrance ports are on the right housing side.

Although modifications and changes may be suggested by those skilled in the art, it is the intention of the inventors to embody within the patent warranted hereon all changes and modifications as reasonably and properly come within the scope of their contribution to the art.

We claim:

1. A hearing device system comprising:

a stand-alone left BTE hearing aid device having a side-specific structure for wearing behind a left ear of a person;

a stand-alone right BTE hearing aid device having a side-specific structure for wearing behind a right ear of the person;

each of said left BTE hearing aid device and said right BTE hearing aid device having a housing containing a microphone system, with at least three sound entrance ports in the housing and associated with the microphone system; and the at least three sound entrance ports in each housing being disposed substantially along a straight line at the respective housing, the respective side-specific structures of the left BTE hearing aid device and the right BTE hearing aid device causing the respective straight lines of the sound entrance ports at the respective housings to be turned toward a straight-ahead viewing direction of the person.

2. A hearing device system as claimed in claim 1 wherein the respective housings of said left BTE hearing aid device and said right BTE hearing aid device form the respective side-specific structures.

3. A hearing device system as claimed in claim 2 wherein each of the housings has a modular structure comprising a base module and a microphone module, the respective base modules being symmetrical and said microphone modules being side-specific.

4. A hearing device system as claimed in claim 1 wherein the respective sound entrance ports of the respective housings of said left BTE hearing aid device and said right BTE hearing aid device form said side-specific structures.

5. A hearing device system as claimed in claim 1 wherein each of the housings has a modular structure comprising a base module and a microphone module, the respective base modules being symmetrical and said microphone modules being side-specific.

6. A hearing device system as claimed in claim 5 wherein the respective sound entrance ports of the respective housings of said left BTE hearing aid device and said right BTE hearing aid device form said side-specific structures.

7. A hearing device system as claimed in claim 1 wherein each of said microphone systems comprises a plurality of microphones mounted on a microphone carrier.

8. A hearing device system as claimed in claim 7 wherein, in each of said left BTE hearing aid device and said right BTE hearing aid device, the microphones and the microphone carrier form a microphone unit, and wherein the respective microphone units are side-specific for respective installation in said left BTE hearing aid device and said right BTE hearing aid device.

9. A hearing device system as claimed in claim 1 wherein each of said straight lines proceeds substantially through a horizontal plane, when said left BTE hearing aid device and said right BTE hearing aid device are worn by the person.

10. A hearing device system as claimed in claim 1 wherein said left BTE hearing aid device comprises a hook adapted to hold said left BTE hearing aid device behind the left ear, and wherein said right BTE hearing aid device comprises a hook adapted to hold said right BTE hearing aid device behind the right ear, and wherein the respective housings of said left hearing aid device and said right BTE hearing aid device, at least in a housing region containing said sound entrance ports, has a substantially wedge-shaped cross-section tapering in a direction of the hook and widening in an opposite direction.

* * * * *